US009121594B2

(12) United States Patent
Scianna et al.

(10) Patent No.: US 9,121,594 B2
(45) Date of Patent: Sep. 1, 2015

(54) LED REPLACEMENT OF DIRECTIONAL INCANDESCENT LAMPS HAVING A HEAT SPREADER AND CIRCUIT BOARD WITH LIGHT SOURCES AND DRIVER DISPOSED ON OPPOSITE SIDES THEREOF

(75) Inventors: Carlo Scianna, Des Plaines, IL (US); Raymond G. Janik, Wheaton, IL (US); Ted Lowl Thompson, West Lafayette, IN (US)

(73) Assignee: Polybrite International, Inc., Naperville, IL (US)

( * ) Notice: Subject to any disclaimer, the term of this patent is extended or adjusted under 35 U.S.C. 154(b) by 160 days.

(21) Appl. No.: 13/674,508

(22) PCT Filed: May 11, 2011

(86) PCT No.: PCT/US2011/036023

§ 371 (c)(1),
(2), (4) Date: Nov. 12, 2012

(87) PCT Pub. No.: WO2011/143286

PCT Pub. Date: Nov. 17, 2011

(65) Prior Publication Data

US 2013/0114261 A1 May 9, 2013

(51) Int. Cl.

| | |
|---|---|
| ***F21V 29/00*** | (2015.01) |
| ***F21V 23/00*** | (2015.01) |
| ***F21K 99/00*** | (2010.01) |
| ***F21V 29/507*** | (2015.01) |
| *F21Y 101/02* | (2006.01) |
| *F21Y 105/00* | (2006.01) |

(52) U.S. Cl.

CPC ..... *F21V 29/20* (2013.01); *F21K 9/1375* (2013.01); *F21V 23/005* (2013.01); *F21V 23/006* (2013.01); *F21V 29/004* (2013.01); *F21V 29/507* (2015.01); *F21Y 2101/02* (2013.01); *F21Y 2105/001* (2013.01)

(58) Field of Classification Search

CPC ... F21V 23/004; F21V 23/005; F21V 23/006; F21V 29/004; F21V 29/20

USPC ..... 362/294, 373, 218, 800, 249.02

See application file for complete search history.

(56) References Cited

U.S. PATENT DOCUMENTS

| | | | | |
|---|---|---|---|---|
| 7,758,223 | B2 * | 7/2010 | Osawa et al. | 362/547 |
| 7,841,752 | B2 * | 11/2010 | Lee | 362/373 |
| 8,042,969 | B2 * | 10/2011 | Paik et al. | 362/241 |
| 8,222,820 | B2 * | 7/2012 | Wang et al. | 315/32 |
| 8,362,677 | B1 * | 1/2013 | Morejon et al. | 313/46 |
| 8,382,325 | B2 * | 2/2013 | Hisayasu | 362/249.02 |
| 8,430,528 | B2 * | 4/2013 | Yu et al. | 362/249.02 |
| 2006/0098440 | A1 * | 5/2006 | Allen | 362/294 |
| 2009/0244899 | A1 * | 10/2009 | Chyn | 362/294 |
| 2010/0290207 | A1 * | 11/2010 | Chan et al. | 362/20 |

* cited by examiner

*Primary Examiner* — Robert May

(74) *Attorney, Agent, or Firm* — Barnes & Thornburg LLP

(57) ABSTRACT

An LED lamp for replacement of directional incandescent lamps. The lamp comprises a screw base, a plurality of LEDs located in a first position, and a driver for the LEDs located in a second position separate from the first position. A lamp housing is secured to the screw base, with the LEDs and the driver being located in the lamp housing. A heat spreader is mounted in the lamp housing in proximity to the LEDs to remove heat therefrom. The heat spreader can also remove heat from the driver, or the driver can be located in proximity to the screw base and in thermal connection therewith so that heat is transmitted through the screw base.

20 Claims, 9 Drawing Sheets

LED REPLACEMENT OF DIRECTIONAL INCANDESCENT LAMPS HAVING A HEAT SPREADER AND CIRCUIT BOARD WITH LIGHT SOURCES AND DRIVER DISPOSED ON OPPOSITE SIDES THEREOF

RELATED APPLICATION

This application is the non-provisional filing of provisional U.S. patent application Ser. No. 61/333,347, filed May 11, 2010.

BACKGROUND OF THE INVENTION

This invention relates to LED lamps, and in particular to an LED lamp for replacement of directional incandescent lamps, such as spot and flood lamps.

Incandescent lamps are slowly being replaced with more modern lamps, including LED lamps. Low intensity LED lamps can provide efficient light without the need for a large heat sink, but as luminosity increases, providing a practical lamp becomes more difficult, because such lamps are typically designed with massive heat sinks and fins, which affect the aesthetics and functioning of the lamp.

LED lamps are self contained. The power supply for driving the lamps, as well all circuitry, is located within the lamp. U.S. patent application Ser. No. 12/826,774, filed Jun. 30, 2010, the disclosure of which is incorporated herein by reference, discloses an LED lamp replacement for low power incandescent lamps. In that lamp, power consumption is low, and heat dissipation is through a multi-layered printed circuit board and a screw base, with that dissipation being sufficient to keep the LED junction temperature under the maximum rated value set by the manufacturer of the LEDs. Increased power and luminosity, however, require an external sink that dissipates heat that cannot be safely channeled through the lamp screw base.

SUMMARY OF THE INVENTION

The invention is directed to a light bulb or lamp comprising a screw base, a light emitting source located in a first position, and a driver for the light emitting source located in a second position separate from the first position. A lamp housing is secured to the screw base, with the light emitting source and the driver being located in the lamp housing. A heat spreader is mounted in the lamp housing, with the heat spreader being mounted to remove heat from at least the first position.

In one form of the invention, the heat spreader comprises a metal disc mounted in the housing, with the light emitting source comprising a plurality of light emitting diodes mounted on a circuit board. The circuit board is secured to the heat spreader for thermal transfer from the circuit board to the heat spreader.

In this form of the invention, the lamp housing is heat conductive. The metal disc is mounted in contact with the lamp housing for heat transfer thereto.

The driver is mounted on a circuit board secured to the screw base. An insulator is mounted in and extending from the screw base, with the heat spreader and lamp housing being secured to the insulator.

In a second form of the invention, the heat spreader comprises a bell housing located within the lamp housing and thermally connected to the screw base. The light emitting source comprises a plurality of LEDs which are mounted on one side of a circuit board, with the circuit board being secured to the heat spreader. The driver is mounted on the circuit board on a side opposite to the LEDs.

The circuit board includes an annular thermal interface in contact with the bell housing. Preferably, the bell housing also includes an annular thermal interface in contact with the annular thermal interface of the circuit board. The bell housing is formed to provide both a thermal and electrically conductive path to the screw base.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
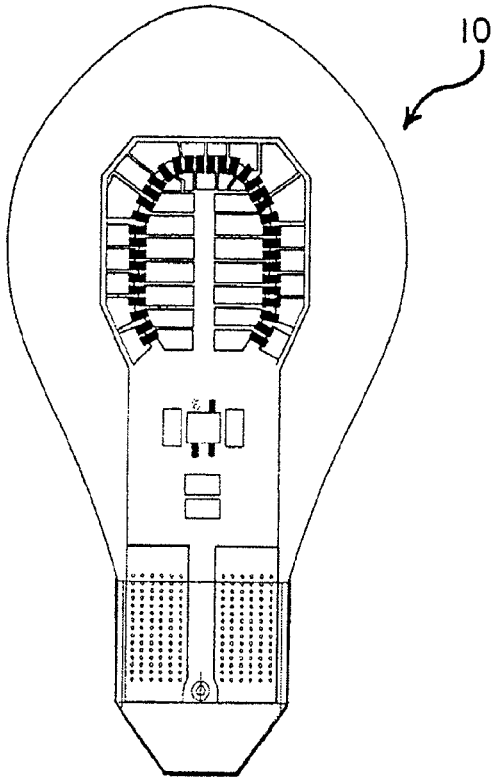
FIG. 1 PRIOR ART
FIG. 1 is an elevational illustration of an LED lamp for replacement of low power incandescent lamps as disclosed in incorporated U.S. patent application Ser. No. 12/826,774.

Incorporated U.S. patent application Ser. No. 12/826,774, filed Jun. 30, 2010, describes an A-type lamp with an LED arrangement that allows light to radiate in a full 360° view angle and maintain the look of a typical incandescent filament. One form of that lamp is shown at 10 in FIG. 1, and reference should be made to the incorporated application for greater detail.

Figure 2A:
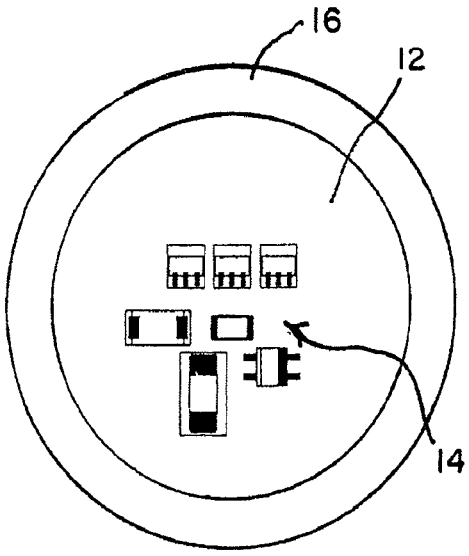
FIG. 2A is a schematic illustration of a printed circuit board bearing the driver for the light emitting source of the lamp of the invention.
Figure 2B:
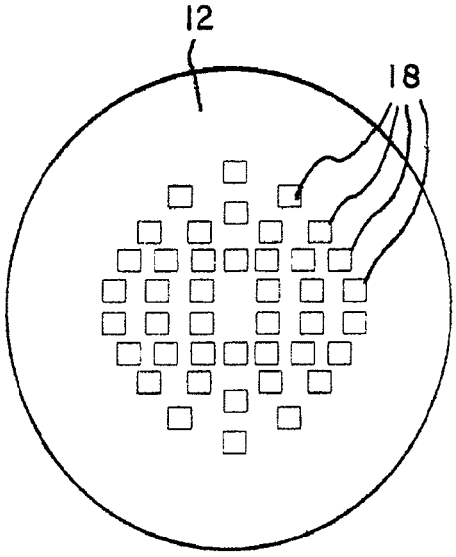
FIG. 2B is a schematic view of the opposite side of the printed circuit board of FIG. 2A, showing population by a plurality of LEDs.
Figures 3A, 3B, 4:
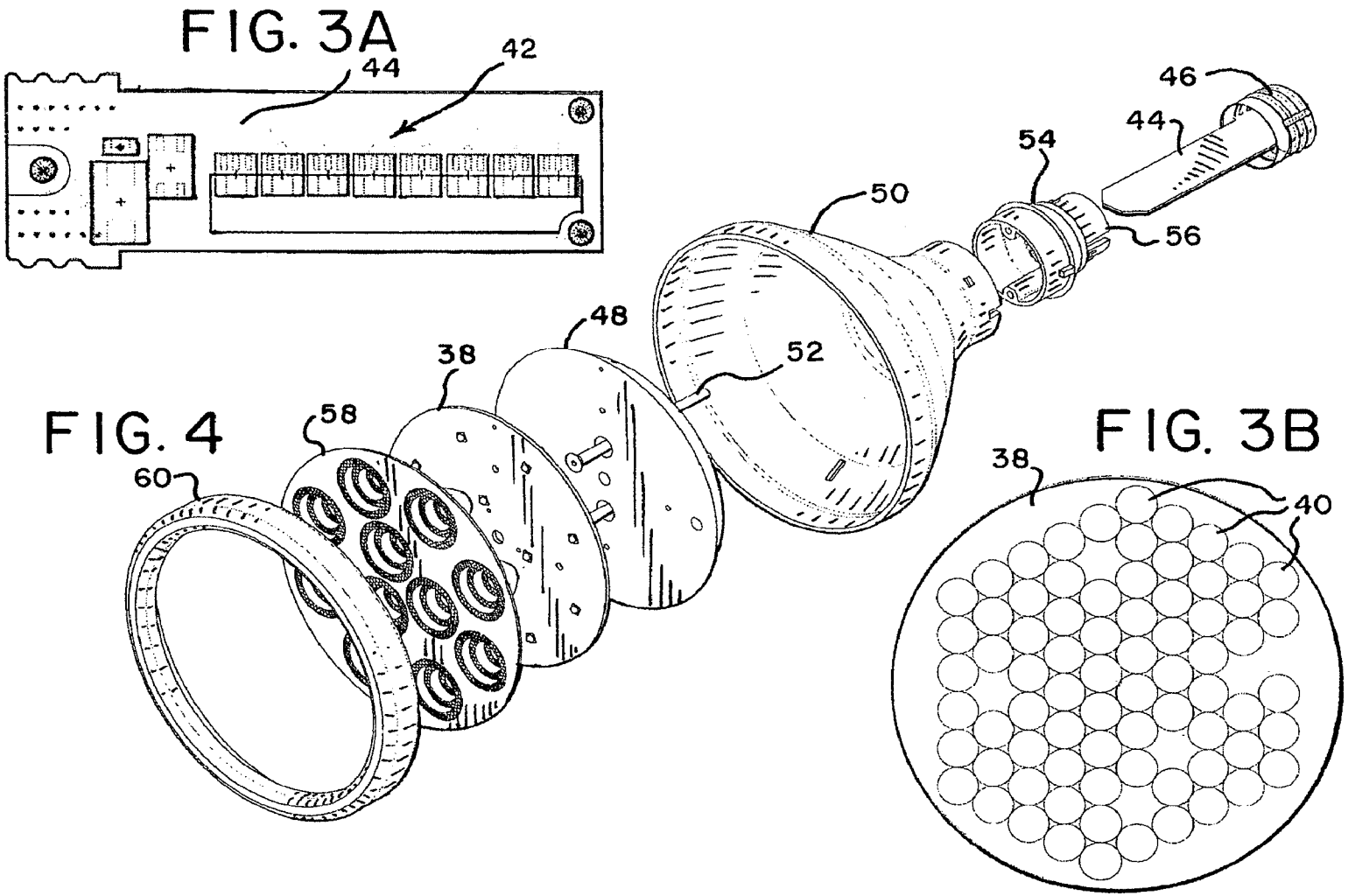
FIG. 3A is a schematic illustration of the driver of a second form of the invention, mounted on a circuit board formed to extend from the screw base.
FIG. 3B is a schematic illustration of the circuit board for the LEDs of the second form of the invention, when populated with a plurality of LEDs.
FIG. 4 is an assembly illustration of the directional lamp of the second form of the invention.
Figures 5, 6:
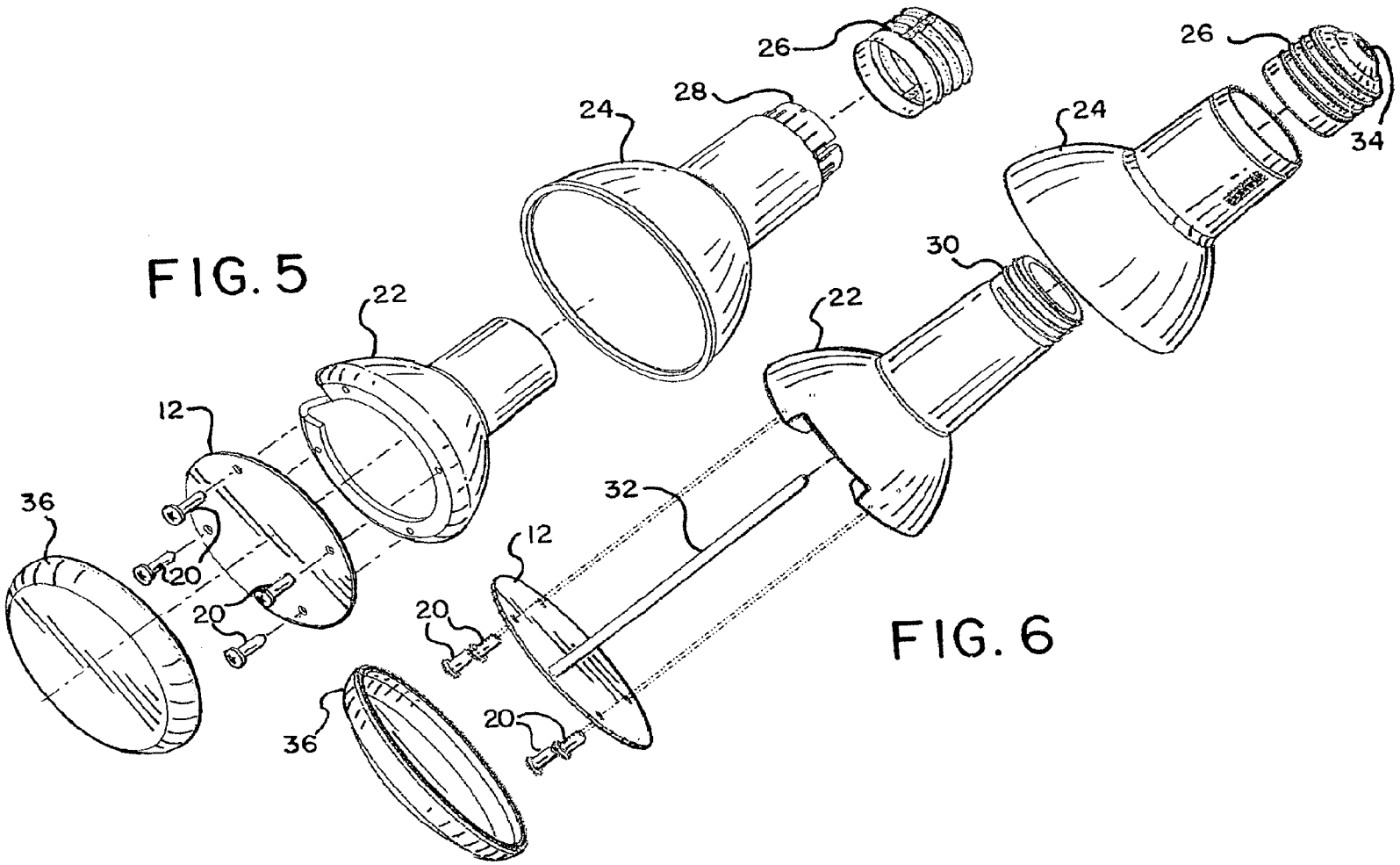
FIG. 5 is an assembly illustration of the directional lamp of the first form of the invention.
FIG. 6 is an assembly illustration similar to FIG. 5, but slightly modified and showing further detail.
Figure 7A:
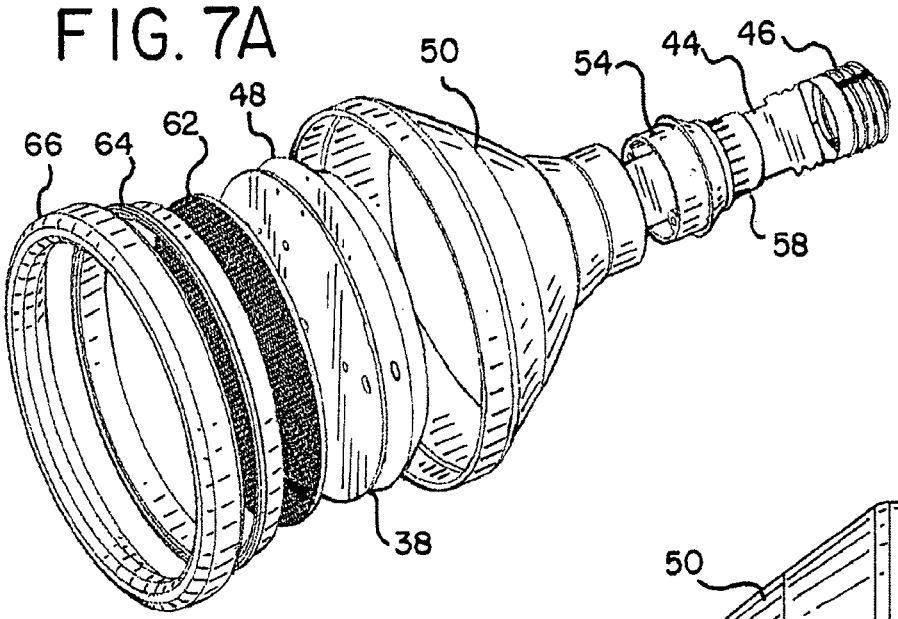
FIG. 7A is an assembly illustration of a slightly modified version of the invention shown in FIG. 4.
Figure 7B:
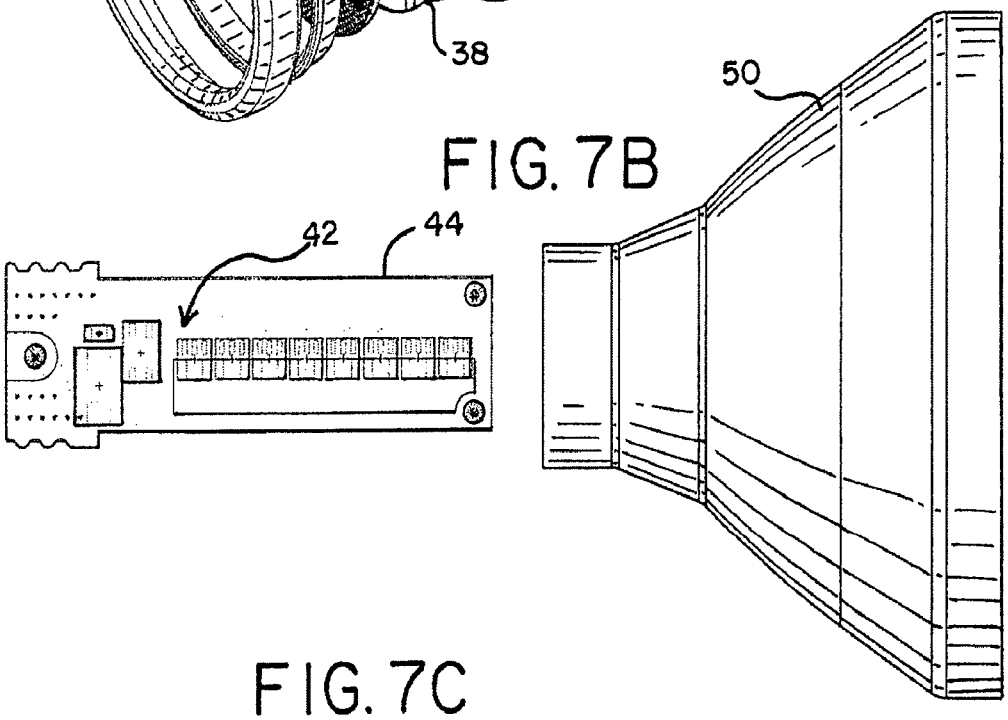
FIG. 7B is an elevational illustration of two components of the lamp of FIG. 7A, showing their relationship in assembly.
Figure 14:
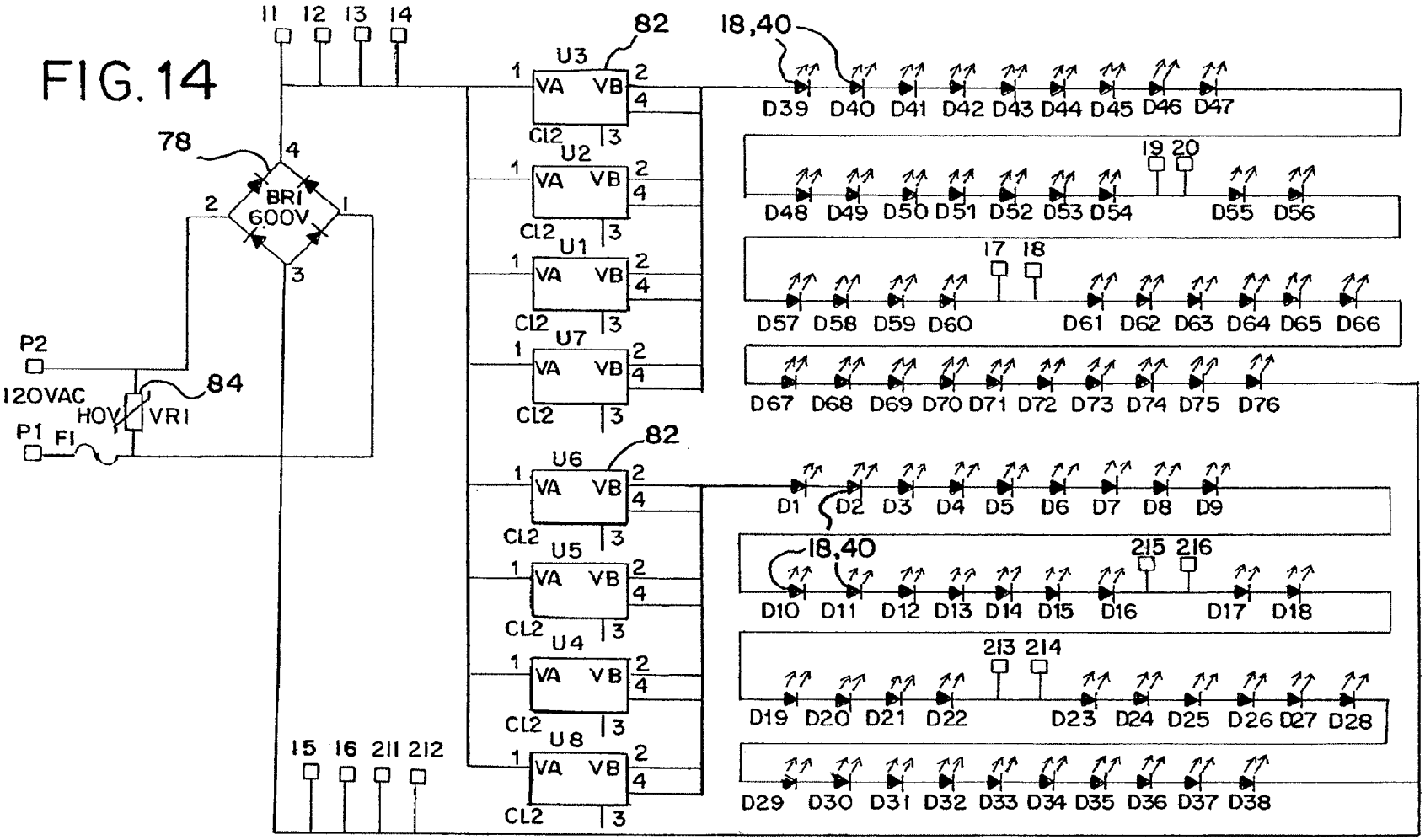
FIG. 14 shows a circuit according to the invention including use of a surge suppressor at the input to limit a temporarily high input voltage and guard against failure.

A first form of the invention is shown in FIGS. 2, 5 and 6. A second form of the invention is shown in FIGS. 3, 4 and 7. Drivers for either form of the invention may be as shown in FIGS. 8 and 14.

The first form of the invention shown in FIGS. 2, 5 and 6 it is a form of a directional lamp according to the invention typically known as R20. In this form of the invention, a printed circuit board 12 is populated on one side by a driver, designated generally at 14. The driver forms no part of the invention, and is therefore shown schematically. An annular thermal interface 16 is located at the outer periphery of the printed circuit board 12. The thermal interface 16 is both thermally conductive and electrically conductive, and preferably is a metal, such as copper.

The opposite side of the printed circuit board 12 is populated with a series of LEDs 18. The LEDs 18 are connected in series, as better shown and described in relation to the circuit of FIG. 14.

The printed circuit board 12 is secured by a series of fasteners 20 to an internal heat spreader 22. In the form of the invention shown in FIG. 5, the internal spreader 22 is located within an external lamp housing 24, the external lamp housing, in turn, being insulative and being installed in a screw base 26 with the internal heat spreader 22 in thermal contact with the screw base 26. An annular periphery 28 of the lamp housing 24 is crimped to the screw base 26, in a conventional fashion, during assembly of the lamp.

In the form shown in FIG. 6, the annular periphery 28 is absent. Instead, the heat spreader 22 is threaded at 30, with the threads 30 being engaged internally in the screw base 26. In either form, the heat spreader 22 is in both thermal and electrical contact with the screw base 26.

In the form of the invention shown in FIG. 6, a wire 32, not shown in FIG. 5, extends from the printed circuit board 12 to a contact 34 in the screw base 26. The wire 32 provides power to the board 12, and the screw base and heat spreader complete the electrical circuit. In both forms shown in FIGS. 5 and 6, a lens cover 36 is installed to complete the lamp.

In the second form of the invention shown in FIGS. 3, 4 and 7, just as in the first form of the invention, a printed circuit board 38 is populated with a series of LEDs 40. The LEDs 18 and LEDs 40 may be identical to one another, and the shapes and sizes shown in the drawing figures are irrelevant.

In this form of the invention, the driver 42 is mounted on a second and separate printed circuit board 44. The printed circuit board 44 is formed to be mounted within a screw base 46. The screw base 46 is therefore a heat sink for the printed circuit board 44 and its mounted driver 42.

A heat spreader 48 is located in a lamp housing 50. Preferably, the heat spreader 48 comprises a metal disk mounted in the housing 50, and the heat spreader is maintained in place within the housing 50 by means of a pair of bolts 52 extending through the heat spreader 48 and engaged in an insulator 54. The lamp housing 50 preferably is metal or any other thermally conductive material, and is electrically isolated from the screw base by means of the insulator 54. The insulator 54 includes an annular periphery 56 which is crimped in the screw base 46 in conventional fashion, to complete installation of the heat spreader 48, housing 50 and insulator 54 in the screw base 46.

In the form of the invention shown in FIG. 4, a lens assembly 58 is mounted over the printed circuit board 38, and held in place by means of a retainer ring 60 secured to the housing 50. In the form shown in FIG. 7, a lens 62 is engaged in a retainer 64, and a retainer ring 66 is secured to the housing 50.

Figure 7C:
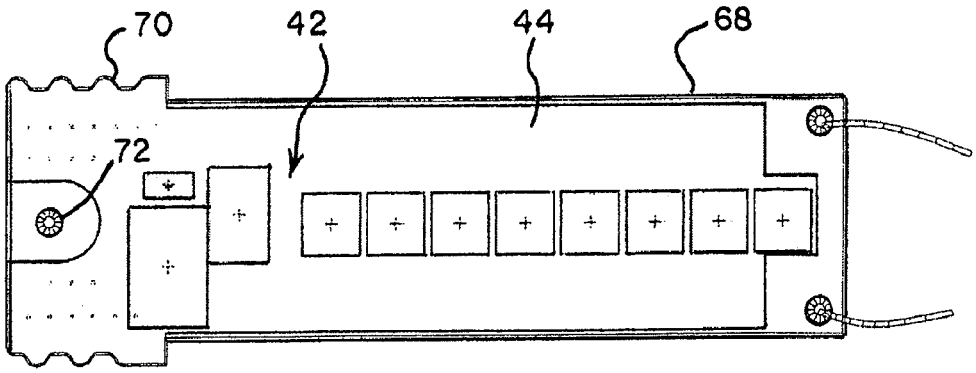
FIG. 7C is an enlarged view of the circuit board shown in FIG. 3A and FIG. 7B.

The printed circuit board 44 is best shown in FIG. 7C. The printed circuit board 44 includes an outer conductive periphery 68, including a screw thread 70 inserted within the screw base 46. The circuit board 44 also includes an isolated contact 72 which is connected to the central contact of the screw base 46 (see the contact 34 of FIG. 6, for example).

Figure 8A:
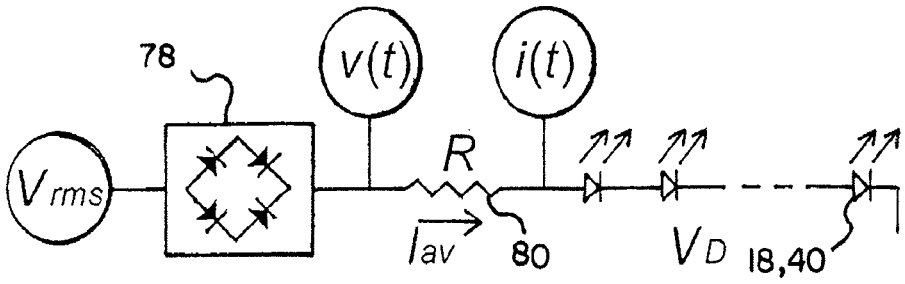
FIG. 8A is a block diagram of a driver using a series dropping resistor to limit input current.
Figure 8B:
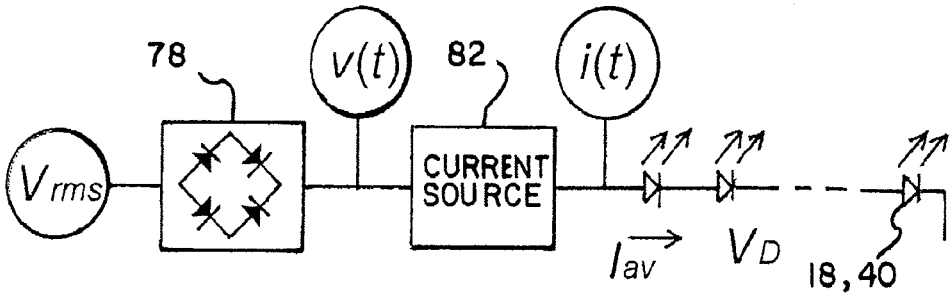
FIG. 8B is a block diagram of a driver using a linear current regulator to limit input current.

A driver is necessary to drive the LEDs 18 and 40. Two drivers are shown in FIGS. 8A and 8B. In both, input voltage, after passing through a rectifier 78, is used to drive the series combinations of the LEDs 18 and 40. In FIG. 8A, in order to limit input current, a resistor 80 is employed, and this type of circuit is also discussed in incorporated U.S. application Ser. No. 12/826,774. In FIG. 8B, instead of the resistor 80, a linear current regulator 82 is employed. The types of drivers illustrated and described are simply for purposes of explanation, and it will be evident that other types of drivers might be employed, as well. The driver forms no part of the present invention.

Figure 9:
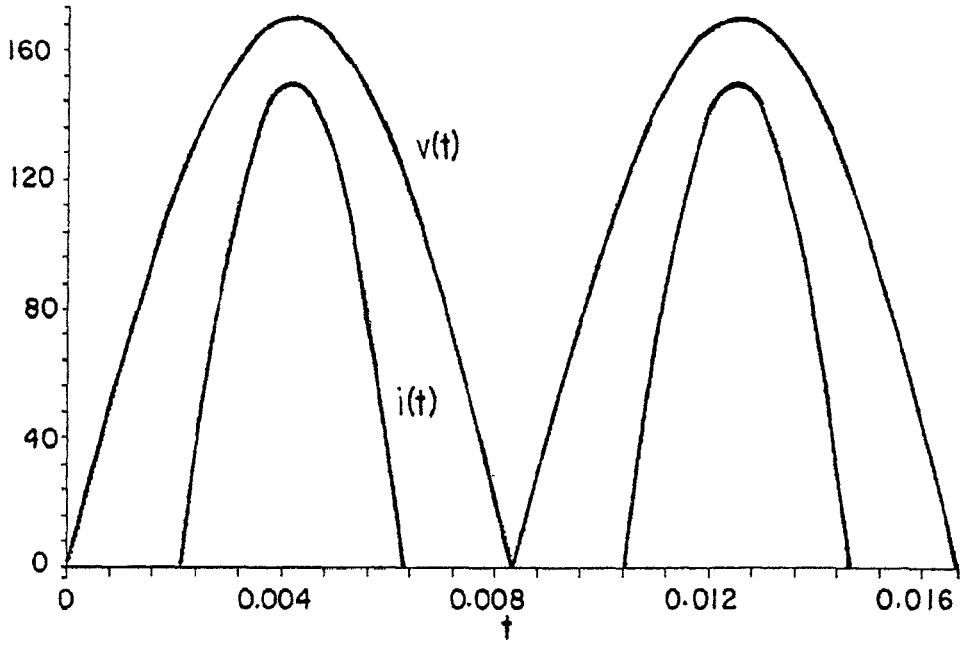
FIG. 9 shows the peak LED current that can be set, using the driver of FIG. 8A.
Figure 10:
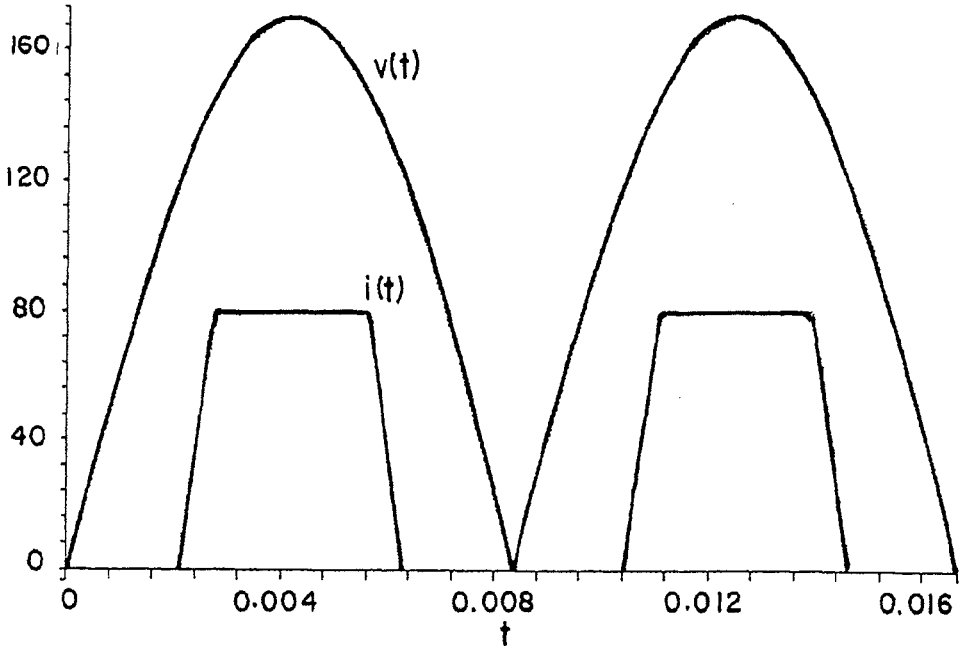
FIG. 10 shows the peak LED current that can be set, using the driver of FIG. 8B.
Figure 11:
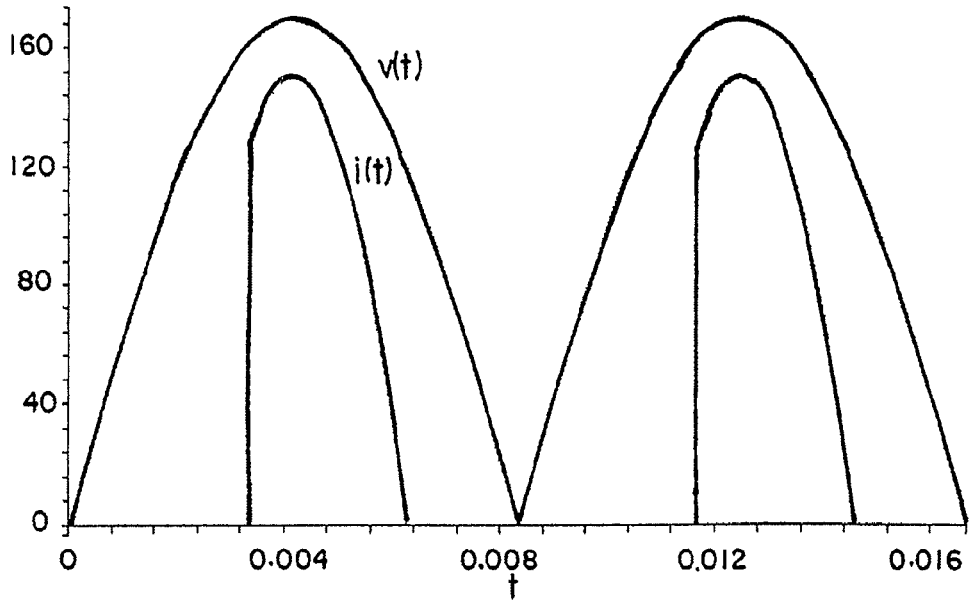
FIGS. 11, 12 and 13A-13C illustrate how an LED lamp will dim with forward phase TRIAC dimmers for circuits shown in FIGS. 8A and 8B at different dimming angles.
Figure 12:
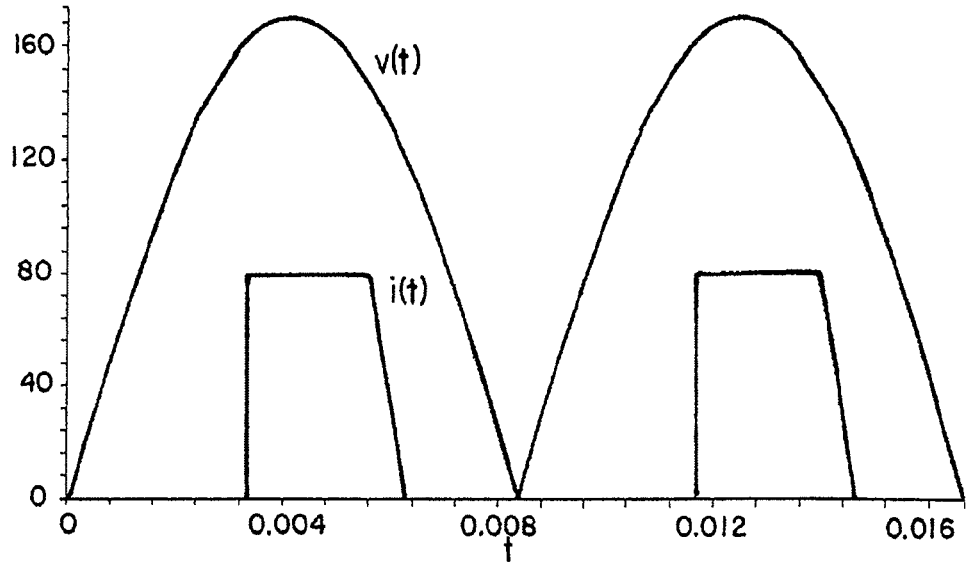
Figure 13A:
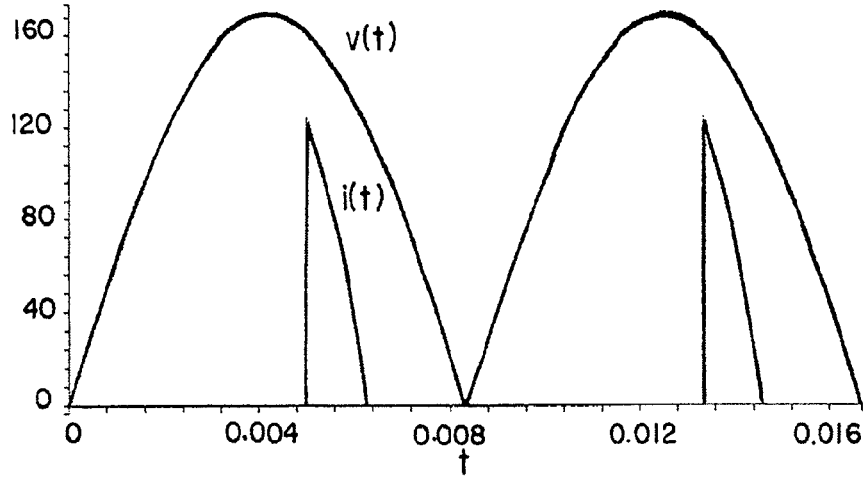
Figure 13B:
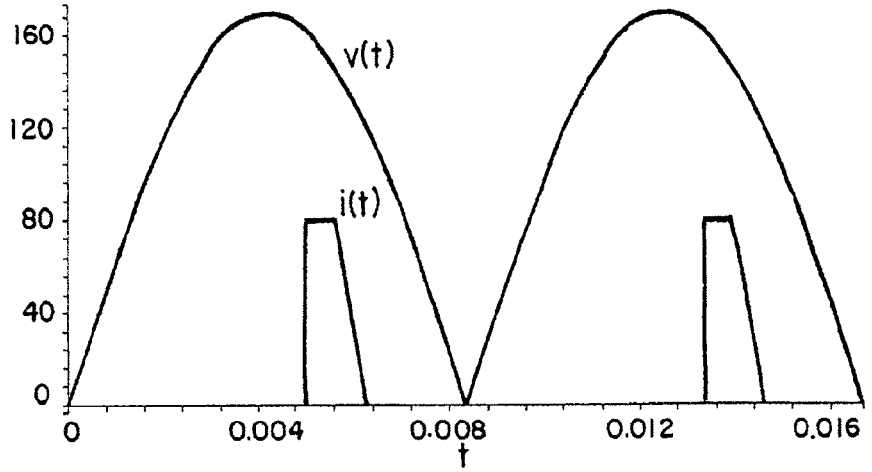
Figure 13C:
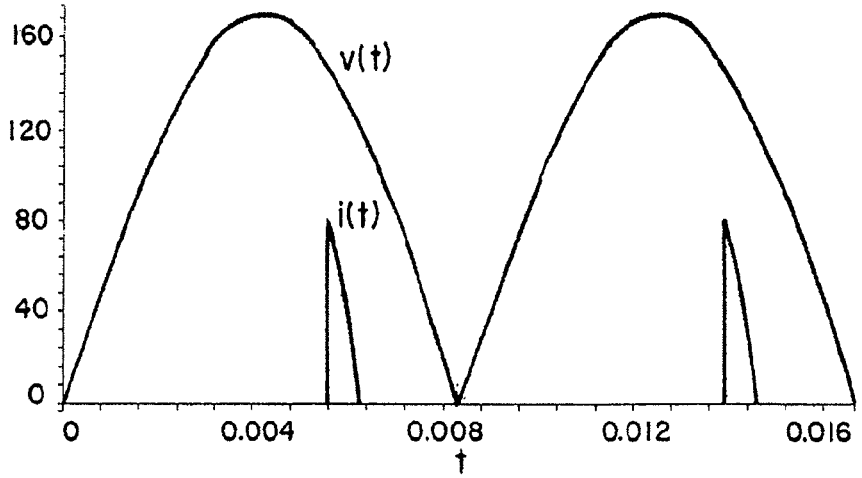

Current regulator 82 is advantageous in that less power is used, and also the peak LED current can be set to not exceed a predetermined value, which insures that the LEDs operate within safe limits established by the manufacturer of the LEDs. This is shown simply and graphically in FIGS. 9 and 10.

When the LED current drops below a constant current set point, the current regulator will no longer clamp the LED current but will be limited by the dynamic resistance of the LEDs and any resistance that is added to the driving circuit. As the input voltage is further reduced, the LED current will drop until the source voltage approaches the LED voltage, at which point the LED will turn off. In a similar fashion, the LED will dim with reverse phase or forward phase dimmers. These concepts are shown schematically in FIGS. 11, 12 and 13A-13C. This is simply for explanation, only, and dimming forms no part of the invention.

A temporary voltage surge to an LED lamp can be destructive. To guard against a surge, a surge suppressor 84 can be employed, as shown in FIG. 14.

The invention permits replacement of a directional incandescent lamp with an LED lamp, with little or no aesthetic difference that is discernible by the user. As shown in FIGS. 2, 5 and 6, the invention replicates an incandescent lamp fully compatible to an R20 lamp that it replaces. As shown in FIGS. 3, 4 and 7, the invention provides a PAR38 lamp fully compatible to the incandescent lamp it replaces. Various changes can be made to the invention without departing from the spirit thereof or scope of the following claims.

What is claimed is:

1. A lamp, comprising a. a screw base, b. a light emitting source located in a first position, c. a driver for said light emitting source located in a second position separate from said first position, wherein the driver and the light source are mounted on opposite sides of a circuit board;

d. a lamp housing secured to said screw base, said light emitting source and said driver being located in said lamp housing, and e. a heat spreader mounted in said lamp housing, said heat spreader being mounted to remove heat from at least said first position wherein the circuit board includes an annular thermal interface in contact with the heat spreader.

2. The lamp according to claim 1, in which said heat spreader comprises a metal disk mounted in said housing, said light emitting source comprising a plurality of light-emitting diodes (LEDs) mounted on a circuit board, said circuit board being secured to said heat spreader.

3. The lamp according to claim 2, in which said lamp housing is heat conductive, said metal disk being in contact with said lamp housing.

4. The lamp according to claim 1, in which said driver is mounted on a circuit board secured to said screw base.

5. The lamp according to claim 1, including an insulator mounted in and extending from said screw base.

6. The lamp according to claim 5, in which said heat spreader and lamp housing are secured to said insulator.

7. The lamp according to claim 1, in which said heat spreader comprises a bell housing located within said lamp housing and thermally connected to said screw base.

8. The lamp according to claim 7, in which said light emitting source comprises a plurality of light-emitting diodes (LEDs) mounted on one side of a circuit board, said circuit board being secured to said heat spreader.

9. The lamp according to claim 8, in which said driver is mounted on said circuit board on a side opposite to said LEDs.

10. The lamp according to claim 7, wherein the annular thermal interface of the circuit board is in contact with said bell housing.

11. The lamp according to claim 10, in which said bell housing includes a second annular thermal interface in contact with the annular thermal interface of said circuit board.

12. The lamp according to claim 7, in which said bell housing is electrically connected to said screw base.

13. A lamp, comprising a. a screw base;

b. a light emitting source located in a first position;

c. a driver for said light emitting source located in a second position separate from said first position, wherein the driver and the light emitting source are mounted on opposite sides of a circuit board;

d. a lamp housing secured to said screw base, said light emitting source and said driver being located in said lamp housing; and e. a heat spreader mounted in said lamp housing, said heat spreader being mounted to remove heat from at least said first position, said heat spreader being thermally connected to said screw base, and wherein the circuit board includes an annular thermal interface in contact with the heat spreader.

14. The lamp according to claim 13, in which said heat spreader comprises a metal disk mounted in said housing, said light emitting source comprising a plurality of light-emitting diodes (LEDs) mounted on a circuit board, said circuit board being secured to said heat spreader.

15. The lamp according to claim 14, in which said lamp housing is heat conductive, said metal disk being in contact with said lamp housing.

16. The lamp according to claim 13, in which said heat spreader comprises a bell housing located within said lamp housing connected to said screw base.

17. The lamp according to claim 16, in which said light emitting source comprises a plurality of light-emitting diodes (LEDs) mounted on one side of a circuit board, said circuit board being secured to said heat spreader.

18. The lamp according to claim 17, in which said driver is mounted on said circuit board on a side opposite to said LEDs.

19. The lamp according to claim 16, wherein the annular thermal interface of the circuit board is in contact with said bell housing.

20. The lamp according to claim 19, in which said bell housing includes a second annular thermal interface in contact with the annular thermal interface of said circuit board.

* * * * *